US006658867B1

(12) United States Patent
Taras et al.

(10) Patent No.: US 6,658,867 B1
(45) Date of Patent: Dec. 9, 2003

(54) PERFORMANCE ENHANCEMENT OF VAPOR COMPRESSION SYSTEM

(75) Inventors: Michael F. Taras, Fayetteville, NY (US); Alexander Lifson, Manlius, NY (US); Thomas J. Dobmeier, Phoenix, NY (US); Howard Fraser, New Woodstock, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/195,697

(22) Filed: Jul. 12, 2002

(51) Int. Cl.[7] ..... F25B 5/00; F25B 41/00
(52) U.S. Cl. ..... 62/117; 62/196.1
(58) Field of Search ..... 62/117, 196.1, 62/175, 332, 238.1

(56) References Cited

U.S. PATENT DOCUMENTS 4,567,733 A * 2/1986 Mecozzi ..... 62/175
4,941,326 A * 7/1990 Sumi et al. ..... 62/180
4,987,952 A * 1/1991 Beal et al. ..... 165/16
5,806,327 A * 9/1998 Lord et al. ..... 62/115
5,839,886 A * 11/1998 Shaw ..... 417/250
6,293,119 B1 * 9/2001 Wenzel ..... 62/238.6

* cited by examiner

*Primary Examiner*—Melvin Jones
(74) *Attorney, Agent, or Firm*—Bachman & LaPointe

(57) ABSTRACT

In an air conditioning system including a compressor, a condenser, and an evaporator, a process includes the steps of feeding discharged refrigerant from the compressor to the condenser so as to provide a condensed refrigerant flow; splitting the condensed refrigerant flow into a main flow and an auxiliary flow wherein the auxiliary flow includes between about 8 and about 12% wt. of total mass flow rate of the condensed refrigerant flow; reducing temperature and pressure of the auxiliary flow so as to provide an economizer flow; passing the economizer flow and the main flow through a heat exchanger so as to provide a sub-cooled main flow and an economizer discharge flow; feeding the economizer discharge flow to the compressor; and feeding the sub-cooled main flow through the evaporator to the compressor. The system and process in accordance with the present invention advantageously allow for parameter optimization, circuit combination, and performance improvement through integration of economized and non-economized circuits.

19 Claims, 2 Drawing Sheets

PERFORMANCE ENHANCEMENT OF VAPOR COMPRESSION SYSTEM

BACKGROUND OF THE INVENTION

The invention relates to vapor compression systems and, more particularly, to performance enhancement in air conditioning systems utilizing economizer cycles.

Economizer cycles can be used to enhance vapor compression system performance in the refrigeration range of compressor operation. Pressure ratios in such systems are high and benefits in efficiency are sufficiently large to justify increased cost in circuit complexity.

In air conditioning operating range systems, however, the pressure ratio is much lower than in typical refrigeration systems, and this makes less desirable the use of economizer cycles and the like in such systems due to minimal return on increased cost and complexity.

It is clear that the need remains for enhanced system efficiency in air conditioning operating range systems.

It is therefore the primary object of the present invention to provide performance enhancement of vapor compression systems in connection with air conditioning operating range systems.

Other objects and advantages of the present invention will appear hereinbelow.

SUMMARY OF THE INVENTION

In accordance with the present invention, the foregoing objects and advantages have been readily attained.

According to the invention, in an air conditioning system comprising a compressor, a condenser, and an evaporator, a process is provided which comprises the steps of feeding discharged refrigerant from said compressor to said condenser so as to provide a condensed refrigerant flow; splitting said condensed refrigerant flow into a main flow and an auxiliary flow wherein said auxiliary flow comprises between about 8 and about 12% wt. of total mass flow rate of said condensed refrigerant flow; reducing temperature and pressure of said auxiliary flow so as to provide an economizer flow; passing said economizer flow and said main flow through a heat exchanger so as to provide a sub-cooled main flow and an economizer discharge flow; feeding said economizer discharge flow to said compressor; and feeding said sub-cooled main flow through said evaporator to said compressor.

In further accordance with the invention, heat exchange with economized refrigerant flow can be carried out for multiple circuits in single heat exchangers, with one or more economizer flow circuits and with flow through the heat exchanger being carried out in parallel and/or in sequence. Further, with multiple circuits, economized and non-economized circuits can be combined.

Thus, in further accordance with the invention, in a multiple circuit air conditioning system comprising at least two circuits each including a compressor, a process is provided which comprises the steps of operating each compressor of said at least two circuits so as to produce at least two discharged refrigerant flows; feeding said at least two discharged refrigerant flows to condensing means for producing at least two condensed refrigerant flows; splitting a condensed refrigerant flow from at least one circuit of said circuits to obtain an auxiliary flow and at least two main condensed refrigerant flows; reducing temperature and pressure of said auxiliary flow so as to provide an economizer flow; passing said economizer flow and said at least two main condensed refrigerant flows through a heat exchanger so as to provide at least two sub-cooled main flows and an economizer discharge flow; feeding said economizer discharge flow to said compressor of said at least one circuit; and feeding said at least two sub-cooled main flows through evaporator means to said compressor of said at least two circuits.

A multiple circuit air conditioning system is also provided, which comprises a first circuit including a series connection of a first compressor, a first condenser, a heat exchanger and evaporator means; a second circuit including a series connection of a second compressor, a second condenser, said heat exchanger and said evaporator means; and at least said first circuit including an economizer circuit including a series connection of said first compressor, said first condenser, an expander, and said heat exchanger.

BRIEF DESCRIPTION OF THE DRAWINGS

A detailed description of preferred embodiments of the present invention follows, with reference to the attached drawings, wherein.

DETAILED DESCRIPTION

The invention relates to air conditioning systems and, more particularly, to air conditioning systems having enhanced performance of the vapor compression system through incorporation of an economizer cycle.

In accordance with the present invention, a process is provided for operation of an air conditioning system which advantageously incorporates economizer circuits into the low-pressure ratio operating conditions of an air conditioning system to enhance operating efficiency of same.

Figure 1:
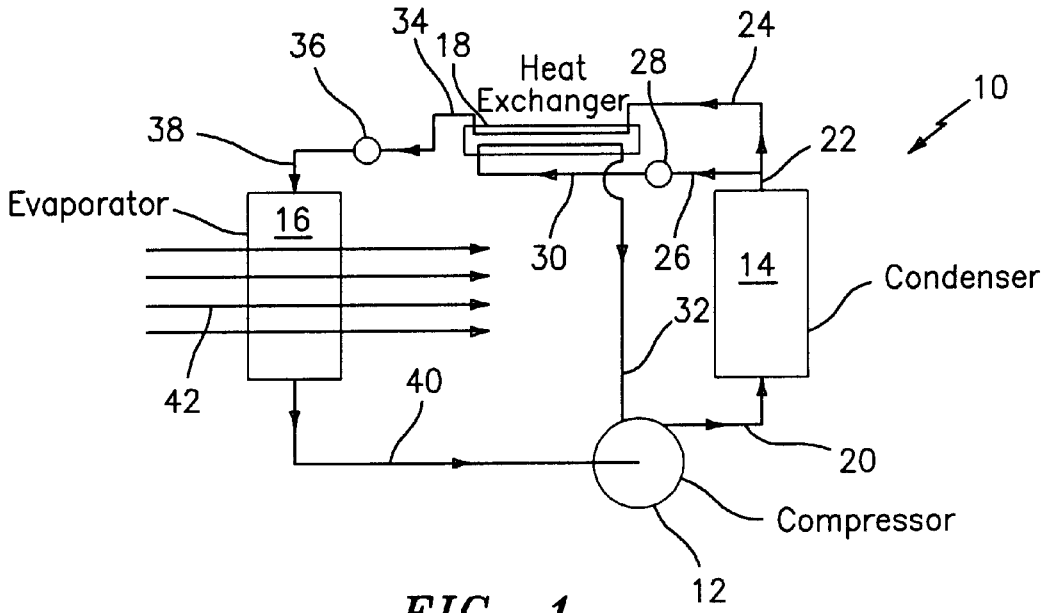
FIG. 1 schematically illustrates an economized air conditioning system in accordance with the present invention.

FIG. 1 schematically illustrates an air conditioning system 10 in accordance with the invention, including a compressor 12, a condenser 14, an evaporator 16, and a heat exchanger 18. Each of these components per se is well known to a person of ordinary skill in the art.

As shown in FIG. 1, compressor 12 has a discharge 20 which leads to condenser 14. Condenser 14 has a discharge line 22 which is split in accordance with the present invention into a main flow line 24 and an auxiliary flow line 26. Auxiliary flow line 26 is fed through an expander 28 for reducing the temperature and pressure of auxiliary flow. From expander 28, an economizer line 30 flows to heat exchanger 18, as does main flow line 24. Heat exchanger 18 has an economizer discharge line 32 and a main discharge line 34. Economizer discharge line 32 feeds back to compressor 12, while main discharge line 34 feeds to an expander 36. From expander 36, line 38 feeds to evaporator 16, which has a discharge line 40 which also feeds to compressor 12, thus defining an operating circuit for the system.

In operation, compressor 12 generates a discharged refrigerant which flows through discharge line 20 to condenser 14. Condenser 14 is operated in accordance with the present invention to provide a minimal of sub-cooling, preferably an amount of sub-cooling which is sufficient to prevent flashing at expander 28. This further advantageously serves to maximize the temperature differential which can be accomplished at heat exchanger 18, which serves to provide for enhanced efficiency of operation of the system. In order to avoid flashing, it is preferred that the condenser be operated to provide condensed refrigerant at a temperature which is greater than the flashing temperature by an amount less than about 20° F. More preferably, it is preferred that the condenser be operated to provide the condensed refrigerant at a temperature which exceeds the flashing temperature by an amount between about 5° F. and about 20° F. This advantageously serves to avoid flashing while providing for operation as desired.

From condenser 14, a condensed refrigerant flow exits through discharge line 22 and is split between main flow line 24 and auxiliary flow line 26.

In accordance with the present invention, it has been found that excellent results can be obtained if the condensed refrigerant flow is split between main flow line 24 and auxiliary flow line 26 such that between about 8% and about 12% (wt.) of the total mass flow rate of the condensed refrigerant flow is fed to auxiliary flow line 26. This splitting of the main and auxiliary flows serves to provide for an efficient balance of main and economizer flows, thereby rendering maximum enhancement in low pressure ratio air conditioning operating range systems.

The auxiliary flow through auxiliary flow line 26 is passed through expander 28 for reducing the temperature and pressure of the auxiliary flow so as to provide an economizer flow which is fed through economizer line 30 to heat exchanger 18. The main flow through main flow line 24 is also fed to heat exchanger 18, preferably in counter-current heat exchange arrangement with economizer flow through economizer line 30. This results in a further sub-cooled refrigerant exiting heat exchanger 18 through main discharge line 34, and an economizer discharge flow through economizer discharge line 32 back to compressor 12.

The sub-cooled main flow is expanded at expander 36 as desired, and fed through line 38 to evaporator 16 wherein it is exposed to a flow of air shown schematically at 42 for allowing refrigerant to evaporate and generate an evaporated refrigerant flow which is fed through line 40 back to the main inlet of compressor 12.

Expander 28 is preferably operated in accordance with the present invention so as to provide the economizer flow with a pressure which is preferably between about 5 and about 20% less, more preferably between about 10 and about 12% less than a conventionally accepted pressure X, wherein X is defined as follows:

$$X=\sqrt{P_S P_D},$$

wherein $P_S$ is suction pressure, and $P_D$ is discharge pressure.

It has been found in accordance with the present invention that operation of an air conditioning range system utilizing the preferred range of economizer refrigerant mass flow rate, coupled with economizer flow pressure lower than conventionally desired, and minimal sub-cooling in the condenser provide for particularly beneficial efficiency and desirable results when incorporating an economizer cycle into an air conditioning operating range system. In accordance with the present invention, an air conditioning system is considered to be one operated at a pressure ratio of less than about 20, and more preferably between about 2 and about 5.

It should be appreciated that the process as schematically illustrated in FIG. 1 provides for unexpected and advantageous benefits when incorporating an economizer cycle into an air conditioning range system despite the much lower pressure ratios used in such systems.

Figure 2:
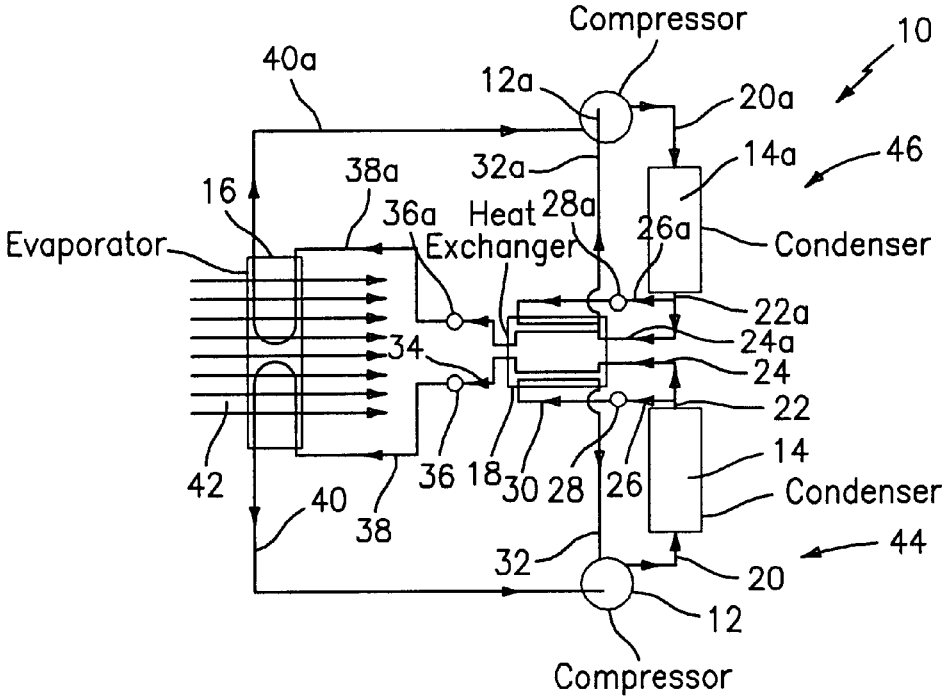
FIG. 2 schematically illustrates a multiple economized circuit system using a single heat exchanger in accordance with the present invention.
Figure 3:
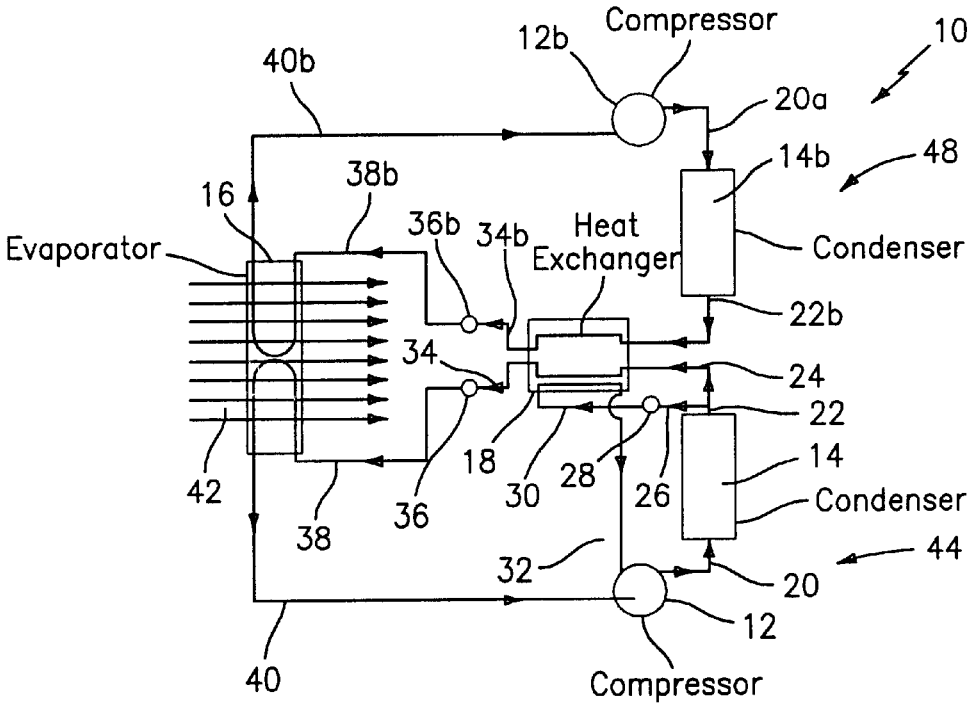
FIG. 3 schematically illustrates a multiple circuit system in accordance with the present invention with sub-cooling of multiple flows carried out in parallel from a single economized circuit.
Figure 4:
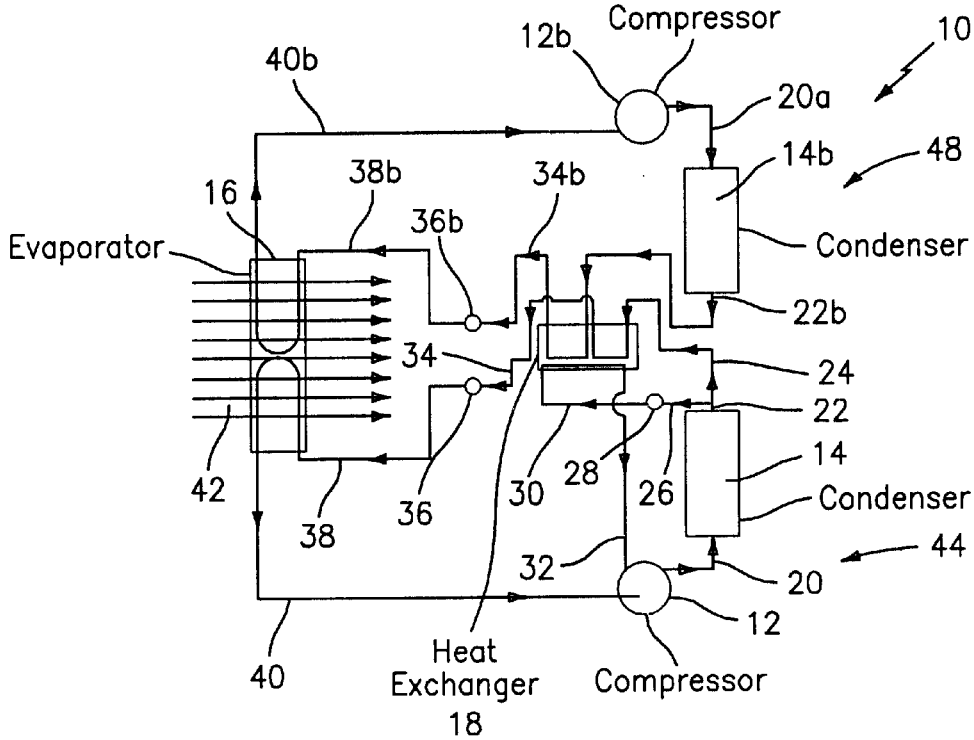
FIG. 4 schematically illustrates a multiple circuit system in accordance with the present invention with sub-cooling of multiple flows carried out sequentially from a single economized circuit.

Turning now to FIGS. 2–4, alternative embodiments are described wherein additional circuits including at least one additional compressor, condenser and evaporator or evaporator portion are provided and economized, advantageously using a single heat exchanger.

FIG. 2 schematically illustrates an embodiment of the present invention wherein a first circuit 44 is defined including the elements substantially as discussed in connection with FIG. 1, and wherein an additional circuit 46 is provided including an additional compressor 12*a*, an additional condenser 14*a*, an additional expander 28*a*, and an additional expander 36*a*. Additional circuit 46 also flows through heat exchanger 18 and evaporator 16 as illustrated. As shown in FIG. 2, condensed refrigerant flow from condensers 14, 14*a*, are both split to provide two main flows through main flow lines 24, 24*a* and two economizer flows through auxiliary flow lines 26, 26*a*. Each auxiliary flow is passed through an expander 28, 28*a*, and then to heat exchanger 18. In the meantime, each main flow 24, 24*a* is also passed through heat exchanger 18 so as to provide main discharge 34, 34*a* which is fed to expanders 36, 36*a* and then to evaporator 16 and back to respective compressors 12, 12*a*. Respective economizer discharge lines 32, 32*a* feed from heat exchanger 18 back to compressors 12, 12*a*. In accordance with this embodiment, the same operating parameters as set forth above are particularly advantageous. Furthermore, and advantageously, a single heat exchanger and economizer are utilized to service both first circuit 44 and additional circuit 46.

FIG. 3 illustrates a further alternate embodiment of the present invention, wherein an additional circuit 48 is provided which does not include an additional economizer cycle. In this embodiment, additional circuit 48 includes compressor 12*b*, condenser 14*b*, heat exchanger 18, expander 36*b* and evaporator 16. Discharge line 22*b* from condenser 14*b* feeds directly to heat exchanger 18 wherein the main condensed flow from first circuit 44 in main discharge line 34 of first circuit 44 and the main discharge in line 34*b* from condenser 14*b* are cooled by economizer flow from first circuit 44 in economizer line 30, in parallel. This provides the benefits of the economizer cycle from first circuit 44 to both first circuit 44 and additional circuit 48, which is particularly advantageous in accordance with the present invention.

FIG. 4 schematically illustrates a further alternative embodiment of the present invention wherein additional circuit 48 is defined in similar fashion to that described in connection with FIG. 3, but wherein main flow from first circuit 44 and main flow from additional circuit 48 are fed in sequence or series through heat exchanger 18, both to be cooled by economizer flow from economizer line 30 as desired. In this embodiment, as well, the benefits of the economizer cycle of first circuit 44 are provided to both circuit 44 and additional circuit 48. As shown, economizer line 30 travels through heat exchanger 18 for a distance, and a first portion of this distance runs adjacent to main flow from first circuit 44, and a second portion of this distance runs adjacent to main flow from additional circuit 48.

In connection with the embodiments of FIGS. 2–4, multiple circuits are disclosed which include at least a compressor. These circuits are also shown in the drawings to each include a condenser and an expander for the main flow prior to entering the evaporator. FIGS. 2–4 also show the multiple circuits advantageously passing through a single heat exchanger, and also passing through a single evaporator. In connection with the evaporator, separate evaporator units could be utilized, if desired. It is particularly advantageous in accordance with the present invention, however, to utilize a single heat exchanger and, preferably, a single evaporator as well.

Also as shown in the drawings, it is particularly advantageous that the single heat exchanger embodiment in accordance with the present invention can be utilized so as to expose multiple circuits to one or more economizer circuits, wherein all circuits can include an economizer circuit, if desired. However, it is particularly advantageous in accordance with the air conditioning system environment of the present invention to utilize a combination of economized and non-economized circuits wherein refrigerant flow from all circuits is exposed to the economized flow in the single heat exchanger.

It should readily be appreciated that the process in accordance with the present invention provides for advantageous incorporation of economizer cycles into one of more air conditioning operating range systems, which advantageously provides for enhanced efficiency in operation of same.

It should further be appreciated that the compressors, condensers, evaporators, expanders and heat exchangers described in accordance with the preferred embodiments can be any of a wide range of specific types of hardware, many variations of which would be readily apparent to a person of ordinary skill in the art.

The splitting of condensed flow in accordance with the preferred ranges as described above, coupled with minimal sub-cooling in condenser 14 and greater reduction in pressure in the economizer cycle than would conventionally be dictated combine to provide for excellent efficiency in operation at air conditioning operation ranges, all as desired in accordance with the present invention.

Further, use of a single heat exchanger with multiple circuits, and combination of economized and non-economized circuits through such heat exchangers, are advantageous improvements in accordance with the invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In an air conditioning system comprising a compressor, a condenser, and an evaporator, the process comprising the steps of:

feeding discharged refrigerant from said compressor to said condenser so as to provide a condensed refrigerant flow;

splitting said condensed refrigerant flow into a main flow and an auxiliary flow wherein said auxiliary flow comprises between about 8 and about 12% wt. of total mass flow rate of said condensed refrigerant flow;

reducing temperature and pressure of said auxiliary flow so as to provide an economizer flow;

passing said economizer flow and said main flow through a heat exchanger so as to provide a sub-cooled main flow and an economizer discharge flow;

feeding said economizer discharge flow to said compressor; and feeding said sub-cooled main flow through said evaporator to said compressor.

2. The process of claim 1, wherein said air conditioning system is operated at a pressure ratio of less than about 20.

3. The process of claim 1, wherein said air conditioning system is operated at a pressure ratio of between about 2 and about 5.

4. The process of claim 1, wherein said reducing step is subject to flashing when said auxiliary flow is expanded at a temperature higher than a flashing temperature, and wherein said condenser is operated to provide said condensed refrigerant flow at a temperature which is greater than said flashing temperature by an amount of less than about 20° F.

5. The process of claim 4, wherein said condenser is operated at a temperature greater than and within about 5 and about 20° F. of said flashing temperature.

6. The process of claim 1, wherein said system comprises at least one additional circuit comprising an additional compressor, an additional condenser and an additional evaporator, and wherein said process further comprises feeding discharged refrigerant from said additional compressor to said additional condenser so as to produce an additional condensed refrigerant flow; flowing at least a portion of said additional condensed refrigerant flow to said heat exchanger so as to provide an additional sub-cooled refrigerant flow; and feeding said additional sub-cooled refrigerant flow through said additional evaporator to said additional compressor.

7. The process of claim 6, further comprising the step of splitting said additional condensed refrigerant flow into an additional main flow and an additional auxiliary flow, reducing temperature and pressure of said additional auxiliary flow so as to provide an additional economizer flow, and passing said additional economizer flow and said additional main flow through said heat exchanger to provide said additional sub-cooled refrigerant flow.

8. The process of claim 6, wherein said main flow and said additional refrigerant flow are exposed to said economizer flow in said heat exchanger in parallel.

9. The process of claim 6, wherein said main flow and said additional refrigerant flow are exposed to said economizer flow in said heat exchanger sequentially.

10. In an air conditioning system comprising a compressor, a condenser, and an evaporator, the process comprising the steps of:

feeding discharged refrigerant from said compressor to said condenser so as to provide a condensed refrigerant flow;

splitting said condensed refrigerant flow into a main flow and an auxiliary flow wherein said auxiliary flow comprises between about 8 and about 12% wt. of total mass flow rate of said condensed refrigerant flow;

reducing temperature and pressure of said auxiliary flow so as to provide an economizer flow;

passing said economizer flow and said main flow through a heat exchanger so as to provide a sub-cooled main flow and an economizer discharge flow;

feeding said economizer discharge flow to said compressor; and feeding said sub-cooled main flow through said evaporator to said compressor, wherein said economizer flow is provided at a pressure between about 5 and about 20% less than X, wherein X is defined as follows:

$$X=\sqrt{P_S P_D},$$

wherein $P_S$ is suction pressure, and $P_D$ is discharge pressure.

11. In a multiple circuit air conditioning system comprising at least two circuits each including a compressor, the process comprising the steps of:

operating each compressor of said at least two circuits so as to produce at least two discharged refrigerant flows;

feeding said at least two discharged refrigerant flows to condensing means for producing at least two condensed refrigerant flows;

splitting a condensed refrigerant flow from at least one circuit of said circuits to obtain an auxiliary flow and at least two main condensed refrigerant flows;

reducing temperature and pressure of said auxiliary flow so as to provide an economizer flow;

passing said economizer flow and said at least two main condensed refrigerant flows through a heat exchanger so as to provide at least two sub-cooled main flows and an economizer discharge flow;

feeding said economizer discharge flow to said compressor of said at least one circuit; and feeding said at least two sub-cooled main flows through evaporator means to said compressor of said at least two circuits.

12. The process of claim 11, wherein said splitting step is carried out so as to provide at least one condensed refrigerant flow which is split, and at least one condensed refrigerant flow which is not split.

13. The process of claim 11, wherein said at least two main condensed refrigerant flows are exposed to said economizer flow in said heat exchanger in parallel.

14. The process of claim 11, wherein said at least two main condensed refrigerant flows are exposed to said economizer flow in said heat exchanger sequentially.

15. A multiple circuit air conditioning system, comprising:

a first circuit including a series connection of a first compressor, a first condenser, a heat exchanger and evaporator means;

a second circuit including a series connection of a second compressor, a second condenser, said heat exchanger and said evaporator means; and at least said first circuit including an economizer circuit including an economizer circuit including a series connection of said first compressor, said first condenser, an expander, and said heat exchanger.

16. The system of claim 15, wherein said economizer circuit defines an economizer flow through said heat exchanger, and wherein said first circuit and said second circuit flow through said heat exchanger in parallel.

17. The system of claim 15, wherein said economizer circuit defines an economizer flow through said heat exchanger, and wherein said first circuit and said second circuit flow through said heat exchanger sequentially.

18. The system of claim 15, wherein said second circuit does not include an economizer circuit.

19. The process of claim 11, wherein said economizer flow is provided at a pressure between about 5 and about 20% less than X, wherein X is defined as follows:

$$X=\sqrt{P_S P_D},$$

wherein $P_S$ is suction pressure, and $P_D$ is discharge pressure.

* * * * *